US005645288A

United States Patent [19]

Lu

[11] Patent Number: 5,645,288

[45] Date of Patent: Jul. 8, 1997

[54] SIZE ADJUSTABLE IN-LINE ROLLER SKATE

[76] Inventor: Jinny Lu, c/o Hung Hsing Patent Service Center P.O. Box 55-1670, Taipei (10477), Taiwan

[21] Appl. No.: 666,615

[22] Filed: Jun. 18, 1996

[51] Int. Cl.[6] ..... A63C 1/22

[52] U.S. Cl. ..... 280/11.26; 280/11.19; 280/11.22; 280/11.3

[58] Field of Search ..... 280/11.23, 11.26, 280/11.3, 11.19, 11.22; 36/115, 117.1

[56] References Cited

U.S. PATENT DOCUMENTS

| | | | |
|---|---|---|---|
| 2,512,906 | 6/1950 | Woolley | 280/11.26 |
| 4,708,352 | 11/1987 | Vullierme | 280/11.26 |
| 5,295,701 | 3/1994 | Reiber et al. | 280/11.27 |
| 5,397,141 | 3/1995 | Hoshizaki et al. | 36/115 |
| 5,421,596 | 6/1995 | Lee | 280/11.2 |

*Primary Examiner*—Eric D. Culbreth

[57] ABSTRACT

A size adjustable in-line roller skate includes: a chassis having a plurality of wheels linearly rotatably mounted under the chassis, a toe box member for enclosing a wearer's toes slidably engageable with and adjustably secured on a front portion of the chassis, and a heel enclosing member for enclosing the wearer's heel slidably engageable with and adjustably secured on a rear portion of the chassis, whereby upon a forward or backward movement of either the toe box member or the heel enclosing member, or both member's along the chassis, different lengths of the skate can be adjusted for obtaining the desired size of the wearer's foot or footwear for a comfortable skating.

4 Claims, 6 Drawing Sheets

SIZE ADJUSTABLE IN-LINE ROLLER SKATE

BACKGROUND OF THE INVENTION

A conventional in-line roller skate is made as fixed type, which is not adjustable for meeting different sizes of a wearer especially a teenager who is growing up and gradually increasing his or her foot size.

For manufacturing the skates of different sizes, it is necessary to provide diversified molds for different sizes of skates, thereby increasing investment and production cost.

The present inventor has found the drawbacks of the conventional in-line roller skate and invented the present in-line roller skate for adjusting different sizes or length for the skate wearer.

SUMMARY OF THE INVENTION

The object of the present invention is to provide a size adjustable in-line roller skate including: a chassis having a plurality of wheels linearly rotatably mounted under the chassis, a toe box member for enclosing a wearer's toes slidably engageable with and adjustably secured on a front portion of the chassis, and a heel enclosing member for enclosing the wearer's heel slidably engageable with and adjustably secured on a rear portion of the chassis, whereby upon a forward or backward movement of either the toe box member or the heel enclosing member, or both members along the chassis, different lengths of the skate can be adjusted for obtaining the desired size of the wearer's foot or footwear for a comfortable skating.

DETAILED DESCRIPTION

Figure 1:
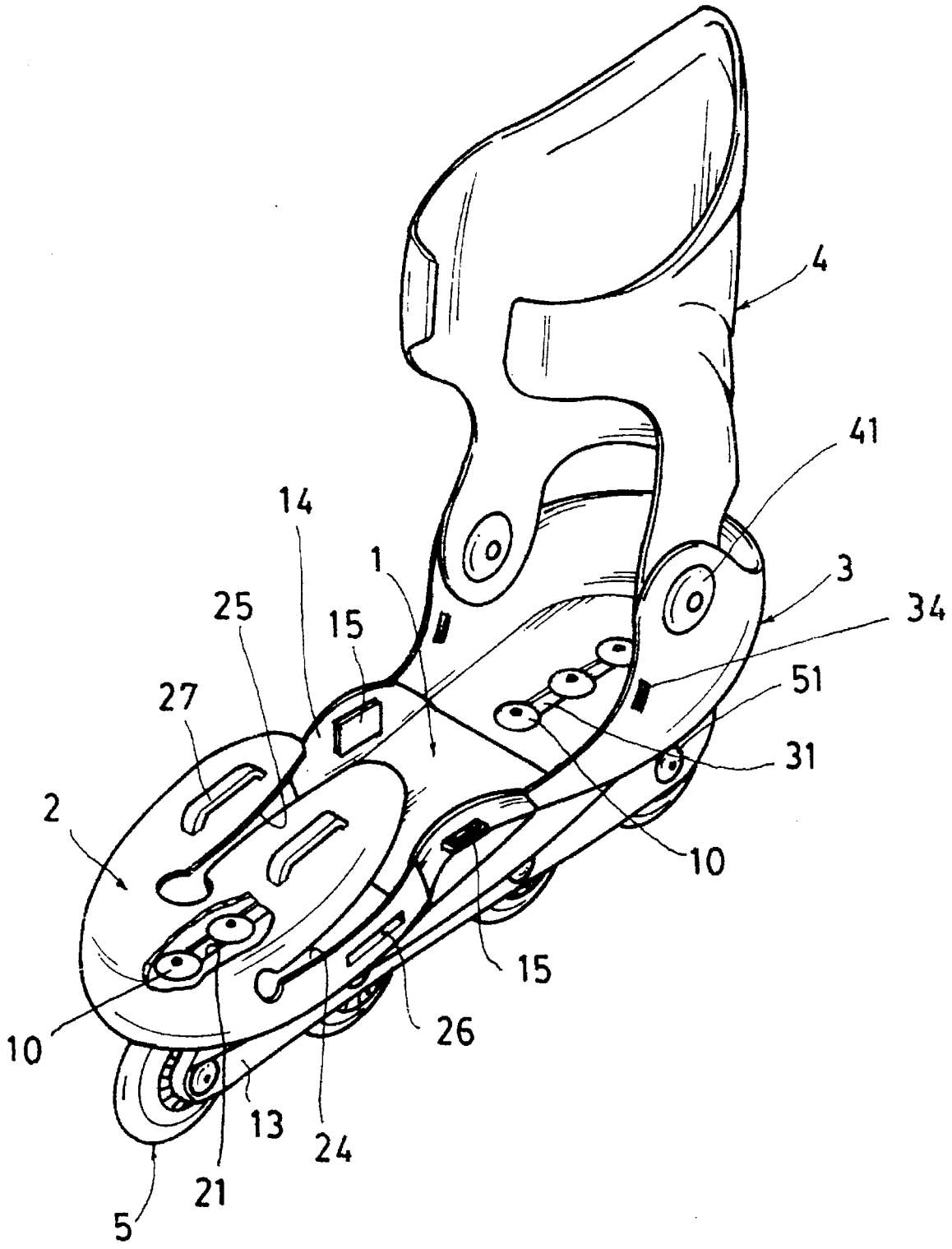
FIG. 1 is a perspective view of the present invention.

As shown in FIGS. 1–5, the present invention comprises: a chassis 1 having a plurality of wheels 5 linearly rotatably mounted under the chassis 1; a toe box member 2 slidably engageable with and adjustably secured on a front portion of the chassis 1 for wearing a wearer's toes within the toe box member 2; and a heel enclosing member 3 slidably engageable with and adjustably secured on a rear portion of the chassis 1. Upon a sliding movement of the toe box member 2 and the heel enclosing member 3 on the chassis 1, a suitable length between the toe box member 2 and the heel enclosing member 3 is obtained to meet a size of a wearer's foot or footwear for his or her comfortable wearing.

A rear shield or cuff 4 is pivotally secured to the heel enclosing member 3 by a pair of pivots 41 for protecting the wearer's heel portion.

Figure 6:
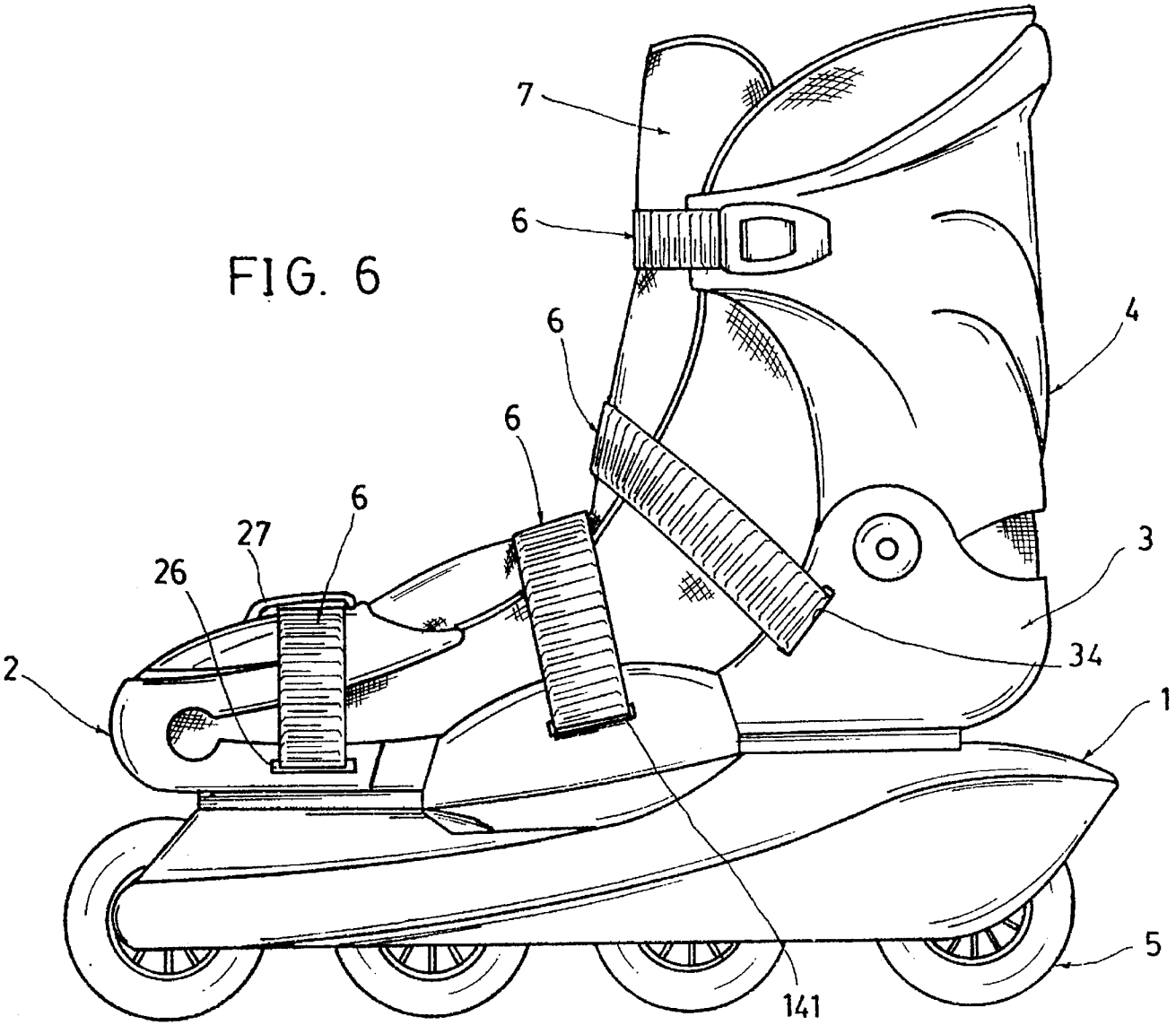
FIG. 6 shows the skate of the present invention lined with an inner lining therein.

A plurality of buckle means 6 may be provided on the present invention for firmly fastening the toe box member 2, a central portion of the chassis 1, the heel enclosing member 3, and the rear shield 4 on a wearer's foot or sporting footwear 8 (FIG. 7) as worn on the wearer's foot. An inner lining 7 may be inserted in the skate of the present invention (as shown in FIG. 6) for protecting a wearer's foot not worn with the sporting footwear 8.

The chassis 1 includes: a front groove 11 longitudinally recessed in a front portion of the chassis 1 having a plurality of screw holes 101 linearly formed in the front groove 11 each screw hole 101 inserted therein by a screw 10 for fixing the toe box member 2 on the front portion of the chassis 1, a rear groove 12 longitudinally recessed in a rear portion of the chassis 1 having a plurality of screw holes 101 linearly formed in the rear groove 12 each screw hole 101 insertable therein by a screw 10 for fixing the heel enclosing member 3 on the rear portion of the chassis, a bracket 13 protruding downwardly from the chassis 1 for rotatably mounting the wheels 5 on the bracket 13 by axles 51, a pair of side flaps 14 disposed on two opposite side portions of the chassis 1 each side flap 14 formed with a fastening slot 141 therein for securing a strap fastener 15 of the buckle means 6 in the slot 141 for fastening the buckle means 6 across the central portion of the chassis of the roller skate.

Figure 7:
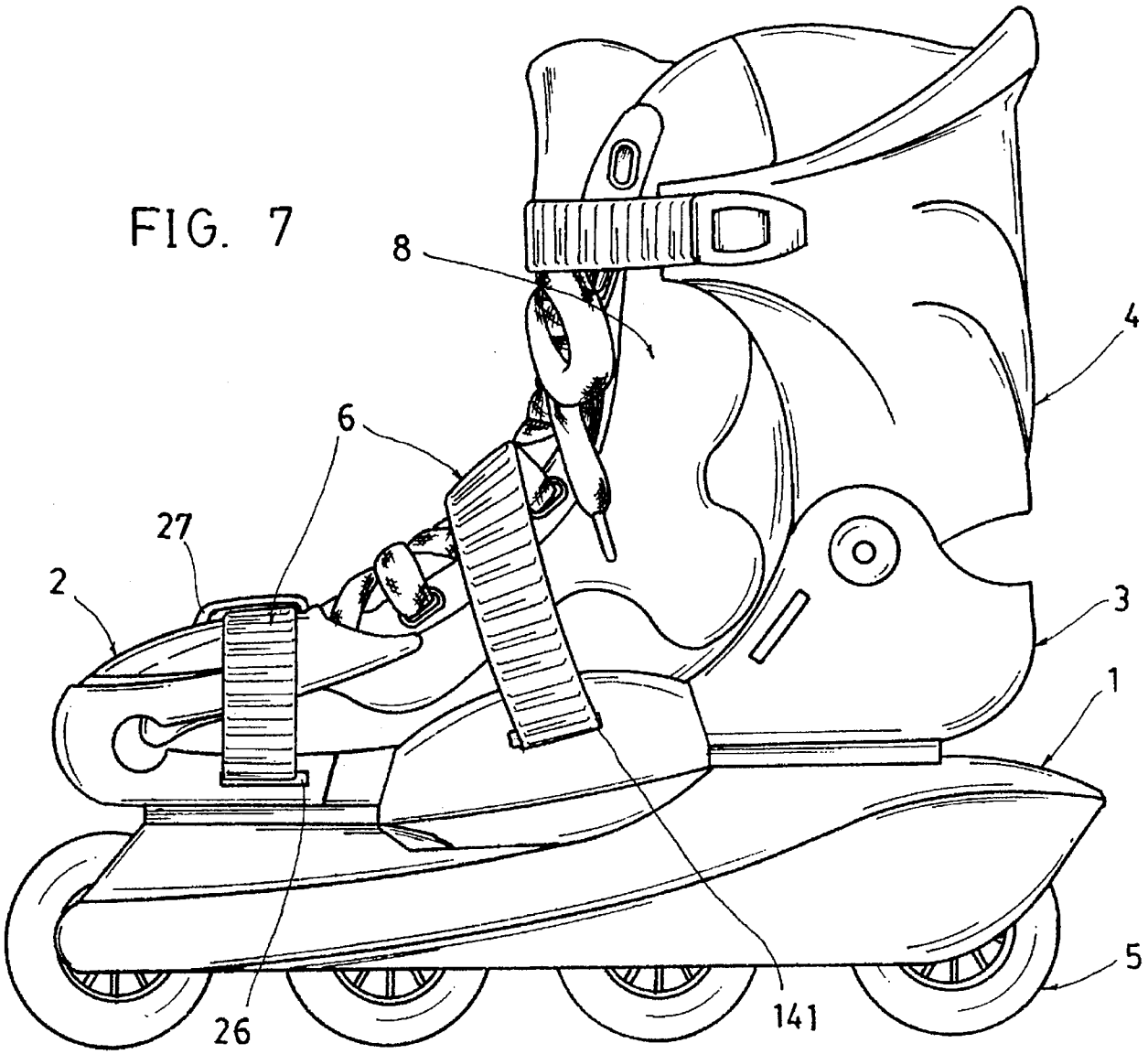
FIG. 7 shows the skate of the present invention directly worn by a wearer's sporting footwear.

The toe box member 2 includes: a front extension 20 longitudinally formed on a rear bottom portion of the toe box member 2 and slidably engageable with the front groove 11 in the chassis 1, a plurality of screw holes 22 linearly formed in the toe box member 2 and formed through the front extension 20 for fixing each screw 10 through the screw hole 22 in the toe box member 2 and through the screw hole 101 formed in the chassis 1 for fixing the toe box member 2 on the chassis 1 as locked by a nut 102 embedded or "planted" in the chassis (FIG. 4) or retained on a bottom of chassis 1 (FIG. 3), at least a side expansion slot 24 and a central expansion slot 25 notched in the toe box member 2 and expansible for enclosing a sporting footwear 8 as shown in FIG. 7, a plurality of strap fastening slots 26 formed in the toe box member 2 for securing a strap of the buckle means 6 therein, and a plurality of strap fasteners 27 formed on the toe box member 2 for firmly fastening the buckle means 6 on the toe box member 2.

The heel enclosing member 3 includes: a rear extension 30 longitudinally formed on a front bottom portion of the heel enclosing member 3 and slidably engageable with the rear groove 12 in the chassis 1, a plurality of screw holes 32 linearly formed in the heel enclosing member 3 and formed through the rear extension 30 for fixing each screw 10 through the screw hole 32 in the heel enclosing member 3 and through the screw hole 101 formed in the chassis i for fixing the heel enclosing member 3 on the chassis 1 as locked by a nut 102 embedded or "planted" in the chassis or retained on a bottom of chassis 1 (FIG. 3), a plurality of strap fastening slots 34 formed in the heel enclosing member 3 for securing a strap of the buckle means 6 therein for firmly fastening the buckle means 6 on the heel enclosing member 3, and a pair of pivot holes 35 formed in the heel enclosing member 3 for pivotally securing the rear shield 4.

Figure 2:
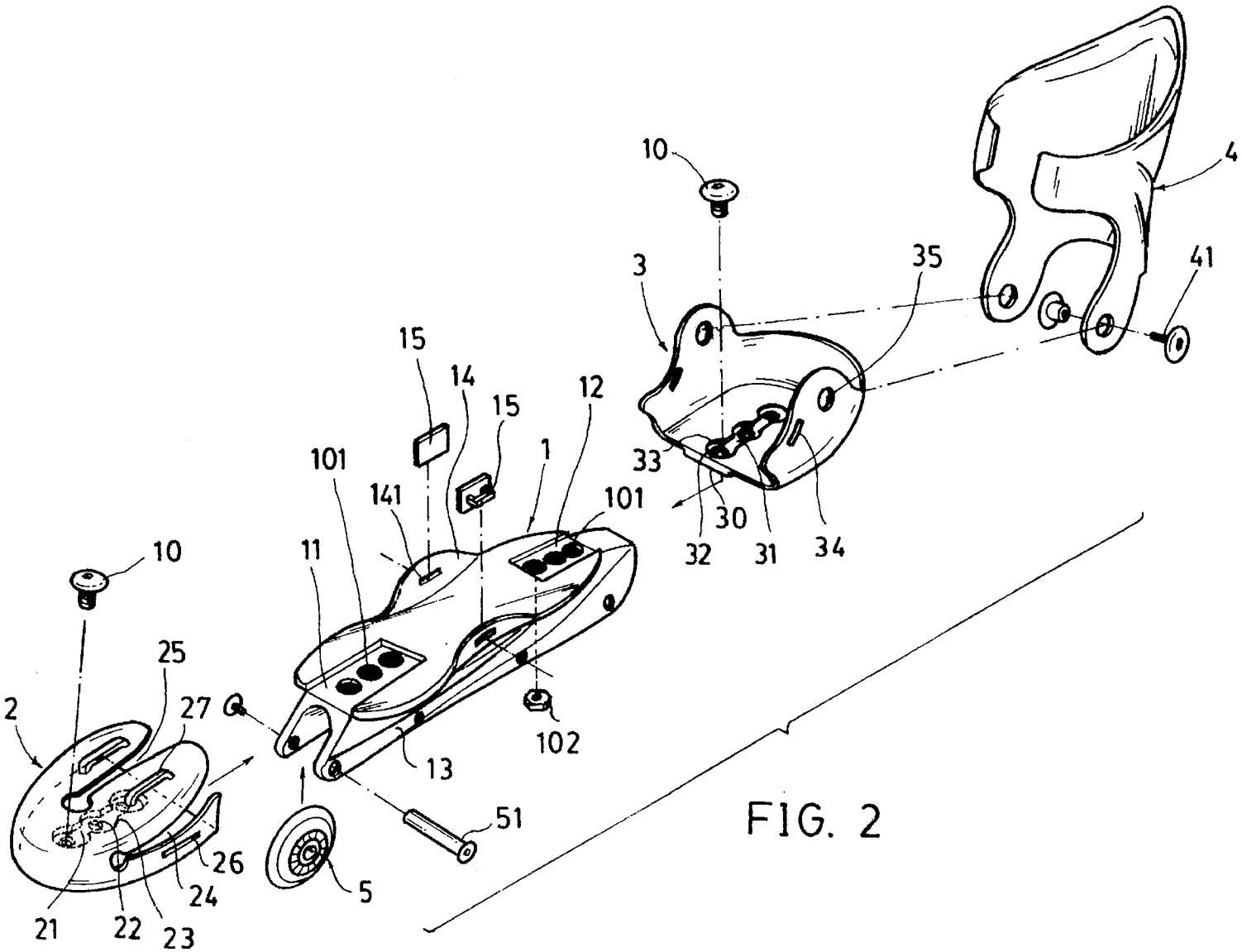
FIG. 2 is an illustration showing the elements in construction of the present invention.
Figure 3:
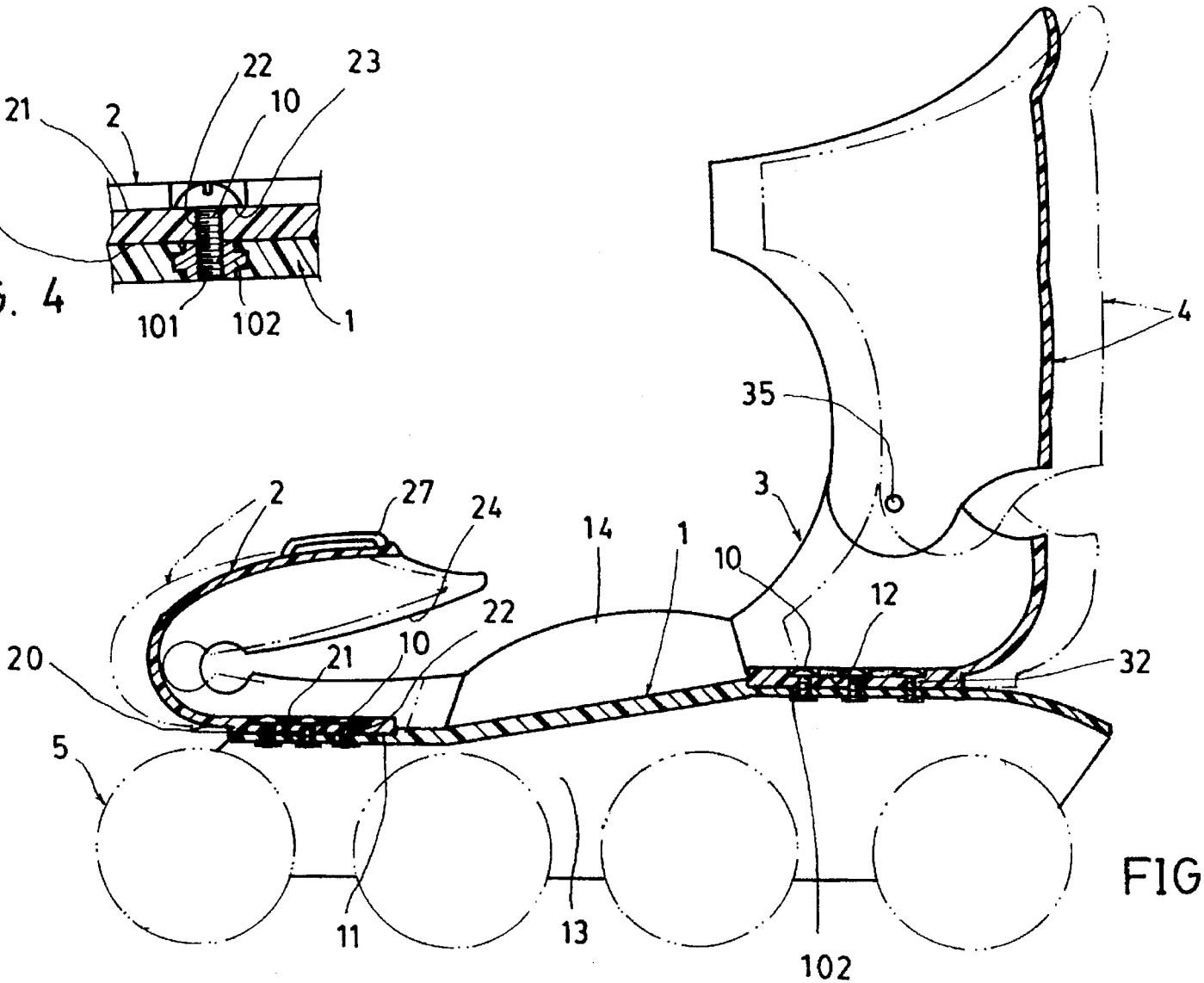
FIG. 3 is a partial sectional drawing of the present invention when assembled.
Figure 4:
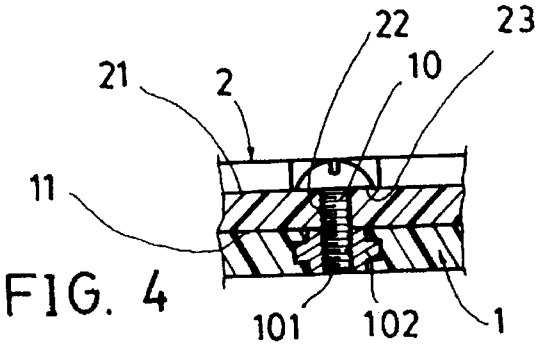
FIG. 4 is a sectional drawing showing the fixation of the toe box member with the chassis by a screw in accordance with the present invention.
Figure 5:
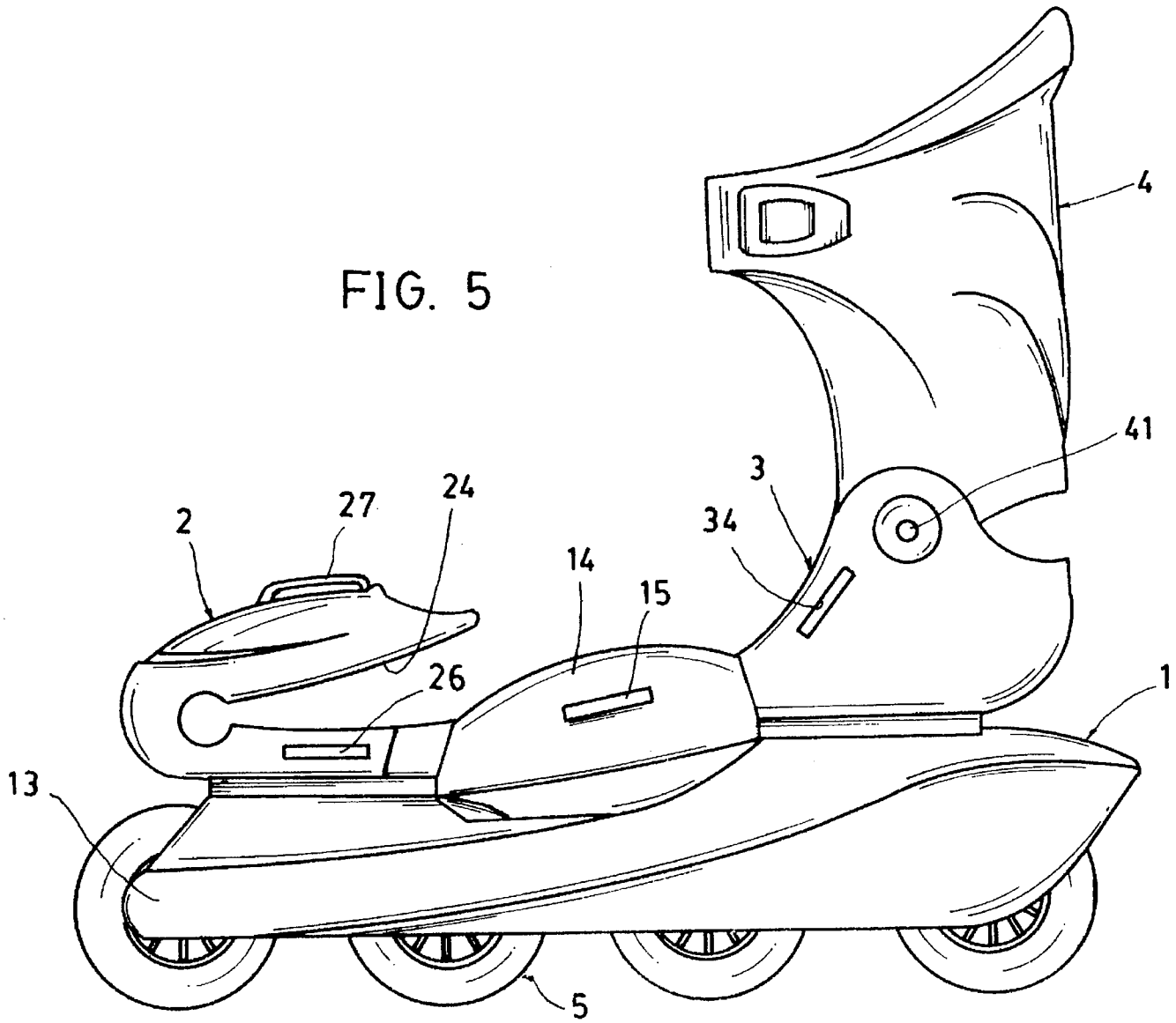
FIG. 5 is a front view of the present invention when assembled.

The toe box member 3 further includes: an elongated recess 21 longitudinally recessed in the toe box member 2 to communicate with the plurality of screw holes 22 formed through the front extension 20 of the toe box member 2 and a plurality of enlarged recesses 23 each communicated with and positioned above each screw hole 22 for holding a screw head portion of the screw 10 when inserted in the screw holes 22, 101 for fixing the toe box member 2 on the chassis 1 as shown in FIGS. 2, 3, 4. The elongated recess 21 is provided for eliminating a stress when the skate of the present invention is worn by a skate player's foot or his (her) footwear.

The numbers of the screws 10 and of the screw holes 22, 32 in the present invention are not limited. The buckle means 6 may also be provided on the rear shield 4 for fastening the rear shield 4 for protecting a wearer's ankle portion. The material for making the toe box member 2 and the heel enclosing member 3 is preferably same as that of the chassis for obtaining a harmonic mechanical strength of the skate.

The heel enclosing member 3 also includes: an elongated recess 31 longitudinally recessed in the heel enclosing member 3 to communicate with the plurality of screw holes 33 formed through the rear extension 30 of the heel enclosing member 3 and a plurality of enlarged recesses 33 each communicated with and positioned above each screw hole 32 for holding a screw head portion of the screw 10 when inserted in the screw holes 32, 101 for fixing the heel enclosing member 3 on the chassis 1 as shown in FIGS. 3, 4. The elongated recess 31 is also provided for eliminating a stress as worn by a skate player.

The present invention may be modified without departing from the spirit and scope as claimed hereinafter.

The present invention is superior to the conventional fixed type in-line roller skate because it can be adjustable for obtaining a suitable size for a comfortable wearing on a player's foot or sporting footwear already worn on the foot of the player. Also, the mold cost can be saved for reducing the investment and production cost for a manufacturer.

I claim:

1. A roller skate comprising:

a chassis (1) having a plurality of wheels (5) linearly rotatably mounted under the chassis (1);

a toe box member (2) slidably engageable with and adjustably secured on a front portion of the chassis (1) for wearing toes of a wearer within the toe box member (2); and a heel enclosing member (3) slidably engageable with and adjustably secured on a rear portion of the chassis (1); whereby upon a sliding adjustment of the toe box member (2) and the heel enclosing member (3) on the chassis (1), a length between the toe box member (2) and the heel enclosing member (3) is obtained to meet a size of a wearer's foot or footwear;

said chassis (1) including: a front groove (11) longitudinally recessed in a front portion of the chassis (1) having a plurality of screw holes (101) linearly formed in the front groove (11), each said screw hole (101) inserted therein by a screw (10) for fixing the toe box member (2) on the front portion of the chassis (1), a rear groove (12) longitudinally recessed in a rear portion of the chassis (1) having a plurality of screw holes (101) linearly formed in the rear groove (12), each said screw hole (101) inserted therein by a screw (10) for fixing the heel enclosing member (3) on the rear portion of the chassis (1), and a pair of side flaps (14) formed on two opposite side portions of the chassis for securing a buckle on said chassis.

2. A roller skate according to claim 1, wherein said toe box member (2) includes: a front extension (20) longitudinally formed on a rear bottom portion of the toe box member (2) and slidably engageable with the front groove (11) in the chassis (1), and a plurality of screw holes (22) linearly formed in the toe box member (2) and formed through the front extension (20) for fixing each said screw (10) through each screw hole (22) in the toe box member (2) and through each screw hole (101) formed in the chassis (1) for fixing the toe box member (2) on the chassis (1).

3. A roller skate according to claim 2, wherein said toe box member (2) is formed with at least a side expansion slot (24) and a central expansion slot (25) notched in the toe box member (2), each said expansion slot (24, 25) expansible for enclosing a sporting footwear within said toe box member (2) on said chassis (1).

4. A roller skate according to claim 1, wherein said heel enclosing member (3) includes: a rear extension (30) longitudinally formed on a front bottom portion of the heel enclosing member (3) and slidably engageable with the rear groove (12) in the chassis (1), and a plurality of screw holes (32) linearly formed in the heel enclosing member (3) and formed through the rear extension (30) for fixing each said screw (10) through the screw hole (32) in the heel enclosing member (3) and through the screw hole (101) formed in the chassis (1) for fixing the heel enclosing member (3) on the chassis (1).

* * * * *